United States Patent [19]

Frunzi et al.

[11] Patent Number: 4,659,024

[45] Date of Patent: Apr. 21, 1987

[54] AMPUL OPENING DEVICE

[75] Inventors: Archie M. Frunzi, Lake Hiawatha; Gregg R. Williams, Budd Lake, both of N.J.

[73] Assignee: Hoffmann-La Roche Inc., Nutley, N.J.

[21] Appl. No.: 789,897

[22] Filed: Oct. 21, 1985

Related U.S. Application Data

[63] Continuation of Ser. No. 499,975, Jun. 1, 1983, abandoned.

[51] Int. Cl.[4] ..... B26F 3/00; B02C 19/14

[52] U.S. Cl. ..... 241/99; 225/93; 81/3.4

[58] Field of Search ..... 81/3.09, 3.34, 3.4; 215/32, 100 R; 225/93; 241/99

[56] References Cited

U.S. PATENT DOCUMENTS

| | | | |
|---|---|---|---|
| 1,956,568 | 5/1934 | Fjord . | |
| 2,066,517 | 1/1937 | Campbell | 241/99 X |
| 2,638,022 | 5/1953 | Reyes | 241/99 X |
| 3,450,319 | 6/1969 | Ray et al. | 241/99 |
| 3,552,083 | 1/1971 | Andersen et al. | 241/99 UX |
| 4,353,869 | 10/1982 | Guth | 241/99 X |

FOREIGN PATENT DOCUMENTS 709088 1/1980 U.S.S.R. .

*Primary Examiner*—Roscoe V. Parker

*Attorney, Agent, or Firm*—Jon S. Saxe; George M. Gould; Dennis P. Tramaloni

[57] ABSTRACT

An ampul opening device is disclosed which enables one to open a glass ampul in a safe and secure manner while minimizing fragmentation of the ampul during opening. The device features a one-piece body structure comprising an ampul holding member having a cylindrical configuration closed or partially closed at one end and having the opposite end open. Integrally attached to the open end is an arm being in line with the vertical axis of the holding member. The arm is of such length as to extend slightly beyond the removable end of the ampul. The upper region of the arm possesses sufficient flexibility to enable the operator to exert a force by means of one's thumb or thumbs to cause the neck of the ampul to fracture cleanly along a narrowly defined transverse fracture path.

10 Claims, 6 Drawing Figures

AMPUL OPENING DEVICE

This is a continuation, of application Ser. No. 499,975 filed June 1, 1983 now abandoned.

BACKGROUND OF THE INVENTION

Materials and, in particular, liquid medicaments are often stored in hermetically sealed containers, such as glass ampuls. The liquid material is introduced into the ampul through a filling opening and the ampul hermetically sealed by flame sealing the filling opening. The technique protects the contents of the ampul from contamination and evaporation.

Ampuls are generally elongated hollow bodies of cylindrical configuration. They are closed at their top ends by tapered tip members which are integrally joined to the body of the ampul by a narrow neck. The neck region is generally constricted and has a weakened fracture zone so that the tip of the ampul can be conveniently snapped off from the container at the neck region. The neck region is weakened by providing a circular score line extending around the axis of the ampul, or the glass in this regon has differential composition bands. Since ampuls are conventionally made of glass, which is brittle and subject to shattering, care must be exercised in snapping off the tip of the ampul at the neck region. If the ampul top does not fracture cleanly at the constricted neck region, it may shatter and small glass fragments may enter the container. In addition, the jagged edges of glass remaining after fracturing of the container may result in injury to the person opening the ampul or using it later. In addition, the bottom of faulty ampuls can shatter during opening, spilling the contents on the opener or resulting in injury from the pieces of glass.

It is an object of this invention, therefore, to provide an ampul opening device which will enable the operator to open an ampul in a safe and secure manner and also minimize fragmentation of the ampul during opening.

It is furthermore an object of the invention to provide a hand tool ampul opening device which will securely support the ampul during opening thereof and which will provide protection for the fingers and hand of the operator.

Other objects and advantages of the present invention, as well as the specific nature thereof, will become readily apparent to those of ordinary skill in the pertinent art from the following detailed description taken in conjunction with the annexed drawings.

BRIEF DESCRIPTION OF THE DRAWINGS

The invention is illustrated by way of example in the accompanying drawings which form part of the application and in which.

DETAILED DESCRIPTION OF THE INVENTION

The present invention relates to an ampul opening device which can be held by the operator in one or both hands.

Structurally, the ampul opening device of this invention features a rigid, one-piece body structure and is of a size designed to fit conveniently within the grasp of one hand or both hands of the user. The device comprises an ampul holding member which is essentially a rigid cylindrical member closed or partially closed at one end; the opposite end is open and of such a size that an ampul can be inserted conveniently therein. Integrally attached to the open end of the holder member is an arm member, said arm member being in line with the vertical axis of said holding member. The arm member is of sufficient length to extend beyond the end of the tapered tip member of the ampul. It is important that the arm member of the ampul opening device of this inventio have no direct contact with the breaking region of the ampul. The arm is characterized as possessing adequate flexibility at the upper portion thereof to allow one to exert sufficient force with the thumb so that the arm member will contact the upper portion of the tapered tip member and break off said tip. The concentrated bending force exerted by the thumb to the opener arm effectively promotes a clean localized fracture in the constricted neck region of the ampul and minimizes the potential for injuring or contamination from fragmentation when the ampul is broken open.

The configuration of the ampul opening device of this invention effectively obviates contact of the user's fingers and/or hand(s) with any portion of the container or ampul while opening the container or following fracture thereof.

In addition to functioning as an ampul opening device, the device is also useful as a holder for the opened ampul and provides ready access to the contents of the ampul, minimizing any chance of the ampul tipping or being knocked over. For example, the contents of the ampul can be removed by means of a syringe without direct hand contact with the ampul itself.

Figure 4A:
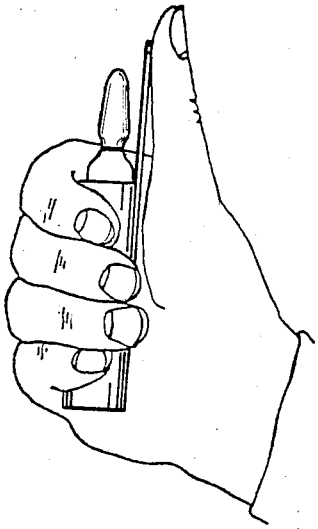
FIG. 4 is several views illustrating operation of the ampul opening.
Figure 4B:
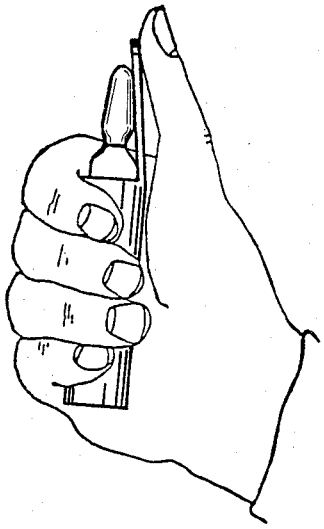
Figure 4C:
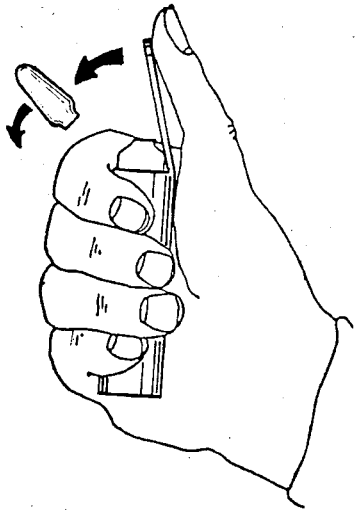

In utilizing the ampul opening device of this invention, see FIG. 4, an ampul is placed in the holder member 1 with the removable tapered ampul tip portion extending out from the open end of the device. The device containing the ampul is conveniently grasped in one hand or two hands by the user with the thumb or thumbs extending along the longitudinal arm member 2. The thumb is positioned at the upper portion of the arm 2 and on the outside of said arm, i.e., the arm member is between the tapered tip of the ampul and the thumb. Applying pressure at the top of the arm member 2 results in the arm member coming in contact with the upper portion of the tapered tip of the ampul. By applying pressure at the upper portion of the tapered tip of the ampul, one utilizes said tapered tip as a torque arm thereby applying maximum force to fracture the ampul cleanly along the break zone in the constricted region.

In accordance with the present invention, the ampul opening device is designed to accomodate standard size ampuls, for example, ampuls having 1, 2, 5, and 10 milliliter capacity. It is formed or otherwise shaped to conveniently fit within the grasp of one hand or two hands of the user. The overall length of the device can be varied to satisfy the above-noted criteria; however, a convenient length for the device is about five inches from the base of the device to the top of the arm member. This length is satisfactory for ampuls having from 1–10 milliter capacity.

Figure 1:
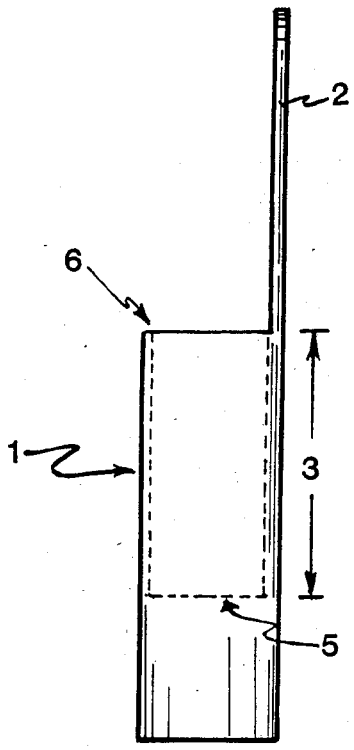
FIG. 1 is a side view of the ampul opening device of the present invention.
Figure 2:
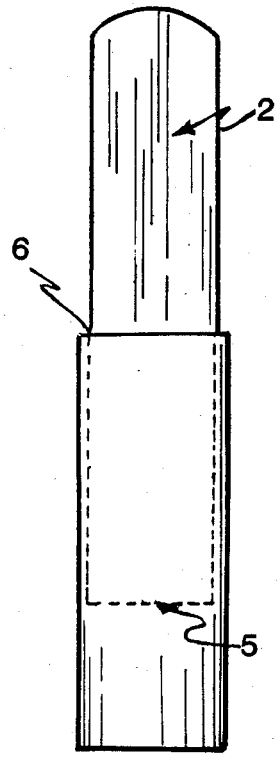
FIG. 2 is a front view of the device shown in FIG. 1.

With reference to FIG. 1, the arm member 2 of the ampul opening device is of sufficient length to extend beyond the end of the tapered tip member of the ampul. With ampuls of 1, 2, 5, and 10 milliliter capacity, the length of the arm member is 1.5", 1.7", 1.9", and 2", respectively. In addition, the arm member 2 is sufficiently wide to provide adequate thumb support and to avoid any thumb contact with the ampul. A convenient width for the arm member of the device is about three-quarters ($\frac{3}{4}$) of an inch.

Parameters which are essential for proper functioning of the ampul opening device of the present invention include the inside diameter of the ampul holding member and the depth of the ampul holding member.

Figure 3:
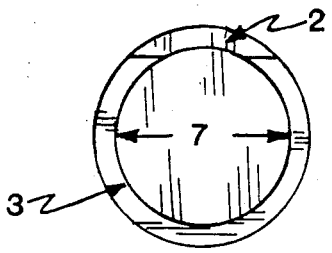
FIG. 3 is a top view of the device shown in FIG. 1.

With reference to FIG. 3, if the diameter of the opening 7 is too small, the user will experience difficulty in inserting and removing the ampul from the device. A diameter which is too large will result in excess movement between the ampul and the wall of the holder. When there is excess motion, the breaking force will not be concentrated at the correct fracture region of the ampul and the fracture will result in jagged edges at the break region and/or cracks in the ampul. With ampuls of 1, 2, 5, and 10 milliliter capacity, the inner diameter 7 of the ampul holding member is about 0.45", 0.53", 0.69", and 0.80", respectively depending on the style of the ampul.

It has also been found that the depth 3 of the ampul holding member, see FIG. 1, is essential to obtain proper functioning of the ampul opening device of the present invention. If the depth 3 is not of the proper distance, the device will not break cleanly, and fragmentation will occur. The depth 3 is the distance from the shoulder 6 of the ampul holding member to the inside bottom 5 of said member wherein the ampul is in contact. With ampuls of 1, 2, 5, and 10 milliliter capacity, the depth of the ampul holding member is about 0.82", 1.05", 1.35", and 1.94", respectively.

In accordance with the present invention, the ampul opening device is formed or otherwise shaped into a one-piece body structure 1 having an arm member 2 integrally attached to the ampul holding member as described hereinabove. The device can be fabricated from plastic materials, for example, polyethylene, polypropylene, polytetraflurorethylene, nylon, and polyvinylchloride. The preferred plastic material is polyethylene which allows the direct viewing of the contents through the plastic and is capable of a multitude of bending operations without failure. Low density polyethylene is particularly well suited for preparing the ampul opening device of this invention.

The ampul opening device of the present invention can be fabricated by conventional tecnhiques for forming plastic structures known in the art. The device can be fabricated by machining molding, for example, blow molding the plastic material.

The base of the ampul opening device is relatively flat or, preferably, slightly concave. This configuration allows the device to stand in an upright position, and the device can function as a holder for the ampul.

The closed bottom is used to contain any liquid which might exit a shattered or faulty ampul.

Figure 5:
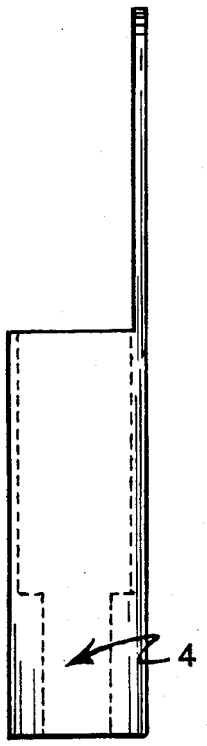
FIG. 5 is a side view of one embodiment of the ampul opening device of the present invention.

In accordance with another embodiment of the present invention, see FIG. 5, the ampul opening device is provided with an opening 4 in the base of the device. The opening in the base allows for easy insertion and removal of an ampul from the device. The size of the opening is not critical; however, it should be smaller than the diameter of the ampul. With ampuls of 1, 2, 5, and 10 milliliter capacity, the diameter of the opening 4 in the base is approximately 0.2", 0.4", and 0.5", respectively.

Figure 6:
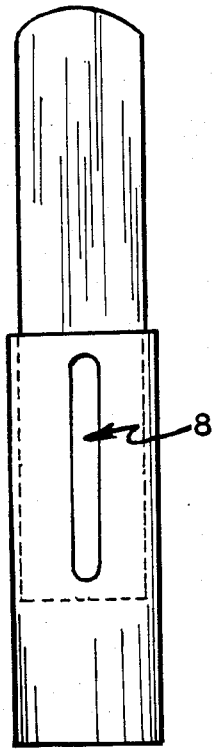
FIG. 6 is a front view of one embodiment of the ampul opening device of the present invention.

In accordance with another embodiment of the present invention, see FIG. 6, the ampul opening device is provided with a view port 8 on the ampul holding member of the device. The view port 8 allows one to see that amount of liquid material in the ampul through an otherwise opaque ampul opener material. The view port 8 is in line with the vertical axis of said holding member and is of sufficient length to allow one to observe most of the ampul. With ampuls of 1, 2, 5, and 10 milliliter capacity, a convenient length for the view port is 0.6", 0.8", 1.25", and 1.7", respectively.

It will, of course, be understood that various details of construction may be modified throughout a wide range of equivalents, and it is, therefore, not the purpose to limit the scope of the invention.

We claim:

1. A device for opening an ampul having at its top end a tapered tip adapted to be snapped off from the body of the ampul along a constricted weakened fracture zone to provide access to the interior of the ampul and which fits within the grasp of one's hand or hands, comprising a one-piece body structure including:

(a) an ampul holding member which is essentially a rigid cylindrical member having a relatively flat base and an opening at the opposite end having a diameter which allows easy insertion and removal of an ampul and a depth which allows positioning of the ampul weakened fracture zone above the holding member opening;

(b) an arm member integrally attached to the open end of the ampul holding member and being in line with the vertical axis of said ampul holding member, said arm being of sufficient length to extend slightly beyond the tapered tip of the ampul and possessing sufficient flexibility at the upper portion to allow one to exert force with one's thumb or thumbs so that said arm member makes contact with the upper portion of the ampul tapered tip thereby utilizing the tapered tip as a torque arm to maximize the applied force to fracture the ampul cleanly along the fracture zone in the constricted region, said arm member having no direct contact with the constricted breaking region of the ampul.

2. The device as defined in claim 1 wherein said device is fabricated from a polymeric material.

3. The device as defined in claim 2 wherein said device is fabricated from polyethylene.

4. The device as defined in claim 1 wherein said device is useful with ampuls of various sizes in the size range between and including 1 to 10 milliliter standard capacity ampuls.

5. The device as defined in claim 1 wherein the ampul holding member has a view port which is in line with the vertical axis of said holding member and is of sufficient length to allow a user to observe most of the ampul.

6. The device as defined in claim 1 wherein the ampul holding member has an opening in the base which is concentric with the base and has a diameter which is less than the diameter of the ampul.

7. The device as defined in claim 2 wherein said device is fabricated from polypropylene.

8. The device as defined in claim 2 wherein said device is fabricated from nylon.

9. The device as defined in claim 2 wherein said device is fabricated from polyvinylchloride.

10. The device as defined in claim 2 wherein said device is fabricated from polytetrafluoroethylene.

* * * * *